US009630117B2

(12) United States Patent
Benecke et al.

(10) Patent No.: US 9,630,117 B2
(45) Date of Patent: Apr. 25, 2017

(54) ANIMATED TOY FIGURE

(71) Applicant: Mattel, Inc., El Segundo, CA (US)

(72) Inventors: Bill Benecke, Los Angeles, CA (US); Thai Cheng Chen, Cerritos, CA (US)

(73) Assignee: Mattel, Inc., El Segundo, CA (US)

( * ) Notice: Subject to any disclaimer, the term of this patent is extended or adjusted under 35 U.S.C. 154(b) by 849 days.

(21) Appl. No.: 13/631,403

(22) Filed: Sep. 28, 2012

(65) Prior Publication Data

US 2013/0084772 A1 Apr. 4, 2013

Related U.S. Application Data

(60) Provisional application No. 61/540,376, filed on Sep. 28, 2011.

(51) Int. Cl.
*A63H 3/20* (2006.01)
*A63H 3/46* (2006.01)

(52) U.S. Cl.
CPC ..... *A63H 3/20* (2013.01); *A63H 3/46* (2013.01)

(58) Field of Classification Search
CPC ... A63H 3/00; A63H 3/20; A63H 3/36; A63H 3/46; A63H 3/48
USPC ..... 446/268, 330, 335, 340, 352, 376, 379, 446/381, 390
See application file for complete search history.

(56) References Cited

U.S. PATENT DOCUMENTS 3,648,405 A 3/1972 Tepper
3,862,513 A * 1/1975 Isaacson ..... A63H 3/20 273/108.22
4,217,726 A 8/1980 Flicker et al.
4,279,419 A * 7/1981 Barnes ..... A63H 13/04 273/108.22
4,536,166 A 8/1985 Renger et al.
4,571,206 A * 2/1986 Mayer ..... A63H 3/20 446/330
4,579,542 A * 4/1986 Mayer ..... A63H 7/00 446/330
4,596,532 A * 6/1986 Cook ..... A63H 3/20 446/330
4,601,672 A * 7/1986 Cook ..... A63H 3/20 446/330
4,605,382 A * 8/1986 Cook ..... A63H 3/20 446/330
4,608,026 A * 8/1986 Newton ..... A63H 3/20 446/330
4,623,318 A * 11/1986 Tsiknopoulos ..... A63H 3/48 446/219
4,802,878 A * 2/1989 Terzian ..... A63H 3/48 446/300
4,968,280 A 11/1990 Kelley
(Continued)

*Primary Examiner* — Gene Kim
*Assistant Examiner* — Alyssa Hylinski
(74) *Attorney, Agent, or Firm* — Kolisch Hartwell, P.C.

(57) ABSTRACT

A toy figure is provided that incorporates a torso, rotatably mounted on a spine, a pelvis fixed to the spine separate from the torso, a movable leg mounted on the pelvis, and a movable arm movably mounted to the torso. A lever extending from the movable leg into the torso rotates the torso on the spine as a result of the motion of the leg. The movable arm, attached to the spine by a linkage, is moved as a result of the relative motion of the rotating torso and the spine. The linkage may be attached within the movable arm near the shoulder or near the elbow.

23 Claims, 16 Drawing Sheets

(56) References Cited

U.S. PATENT DOCUMENTS

| | | | | | |
|---|---|---|---|---|---|
| 5,727,982 | A * | 3/1998 | Hurt | A63H 3/20 | 446/241 |
| 6,012,962 | A * | 1/2000 | Arriola | A63H 3/20 | 446/330 |
| 6,022,263 | A * | 2/2000 | Liu | A63H 3/20 | 446/330 |
| 6,106,359 | A * | 8/2000 | Arriola | A63H 3/20 | 446/236 |
| 6,142,845 | A * | 11/2000 | Feldman | A63H 3/20 | 40/419 |
| 6,152,799 | A * | 11/2000 | Arriola | A63H 3/20 | 446/317 |
| 6,296,543 | B1 * | 10/2001 | Andrews | A63F 7/0668 | 446/297 |
| 7,537,506 | B2 | 5/2009 | de la Torre | | |
| 7,654,881 | B2 * | 2/2010 | Nakazato | A63H 13/06 | 446/334 |
| 2004/0173968 | A1 * | 9/2004 | Mitvalsky | A63F 7/2472 | 273/317.3 |
| 2006/0292965 | A1 | 12/2006 | Strauss | | |
| 2011/0086571 | A1 * | 4/2011 | O'Hare | A63H 3/20 | 446/330 |

* cited by examiner

ANIMATED TOY FIGURE

CROSS-REFERENCE TO RELATED APPLICATIONS

This application claims priority to U.S. Provisional Patent Application Ser. No. 61/540,376, filed Sep. 28, 2011, the disclosure of which is incorporated herein by reference.

FIELD OF THE DISCLOSURE

The present disclosure relates generally to an animated toy figure, such as a doll or toy action figure and, more particularly, to a toy action figure having a head and a rotatable torso, wherein the head remains in a fixed position when the torso is rotated.

BACKGROUND OF THE DISCLOSURE

Examples of toy figures, including dolls and action figures, are disclosed in U.S. Pat. No. 3,648,405, U.S. Pat. No. 4,217,726, U.S. Pat. No. 4,536,166, U.S. Pat. No. 4,623,318, U.S. Pat. No. 4,601,672, U.S. Pat. No. 4,968,280, and U.S. Pat. No. 6,022,263. The disclosures of these and all other publications referenced herein are incorporated by reference in their entirety for all purposes.

Advantages of the present disclosure will be more readily understood after considering the drawings and the Detailed Description.

Figure 1:
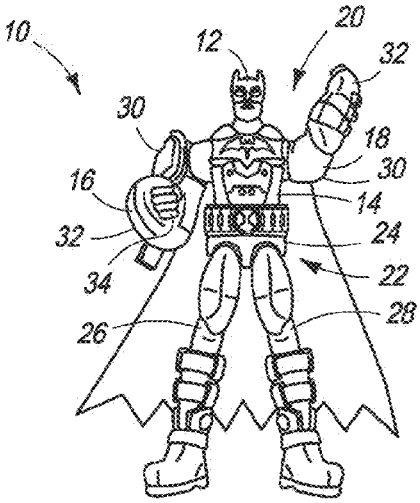
FIG. 1 shows a front view of an exemplary embodiment of an action figure or toy figure in a first, unactuated, or unactived position in accordance with the present disclosure.
Figure 2:
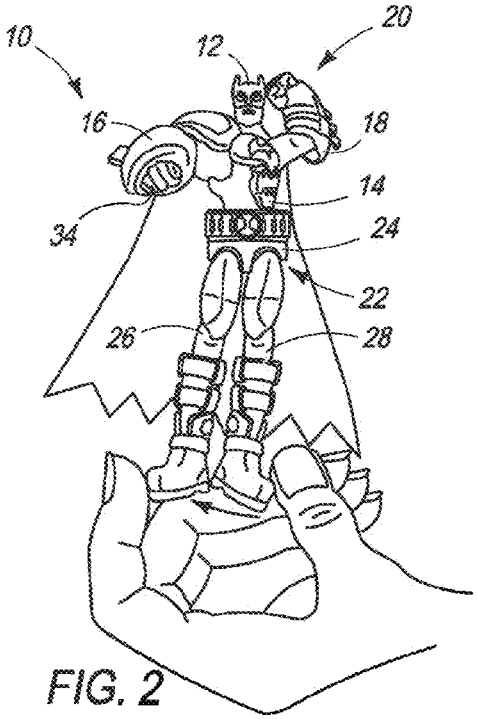
FIG. 2 shows a front view of the action figure of FIG. 1 in a second, actuated, or activated position, in accordance with the present disclosure.
Figure 6:
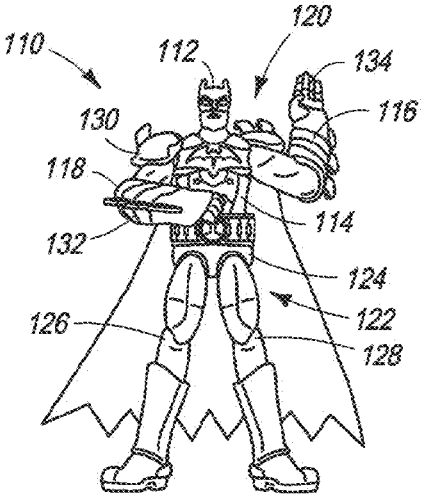
FIG. 6 shows a front view of another exemplary embodiment of an action figure in a first or unactivated position, in accordance with the present disclosure.
Figure 7:
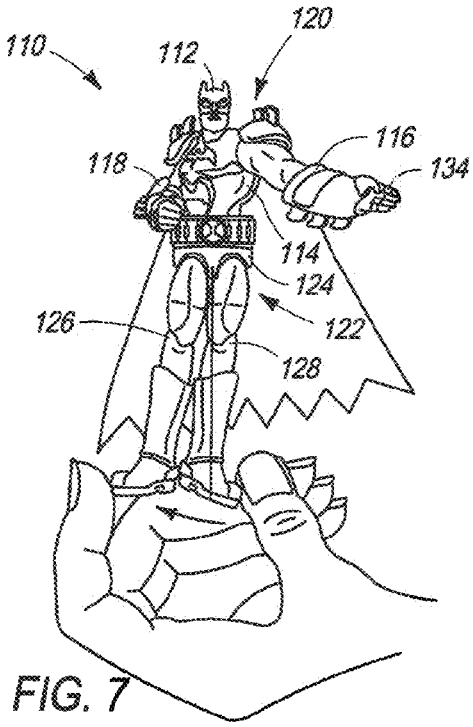
FIG. 7 shows a front view of the action figure of FIG. 6 in an activated position.
Figure 3:
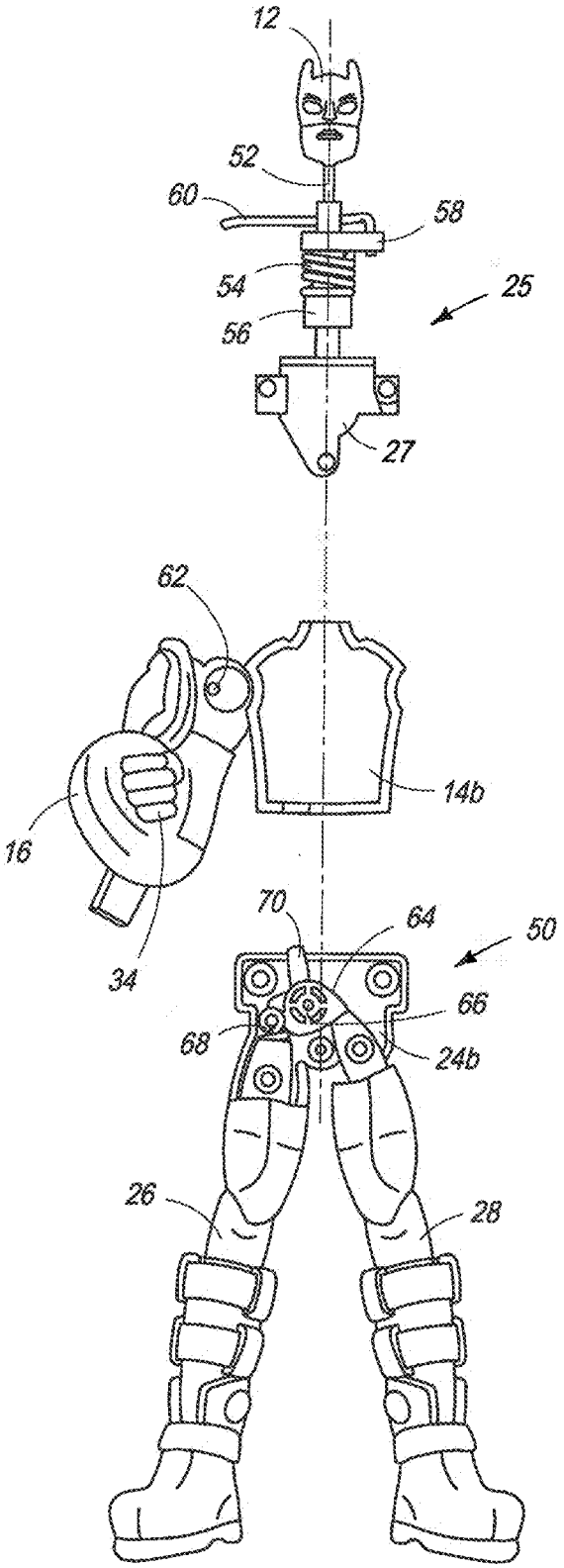
FIG. 3 shows an exploded front view of portions of the action figure of FIG. 1, including a torso, a spine with a pelvic plate, a pelvis, a linkage, and a movable arm.
Figure 4:
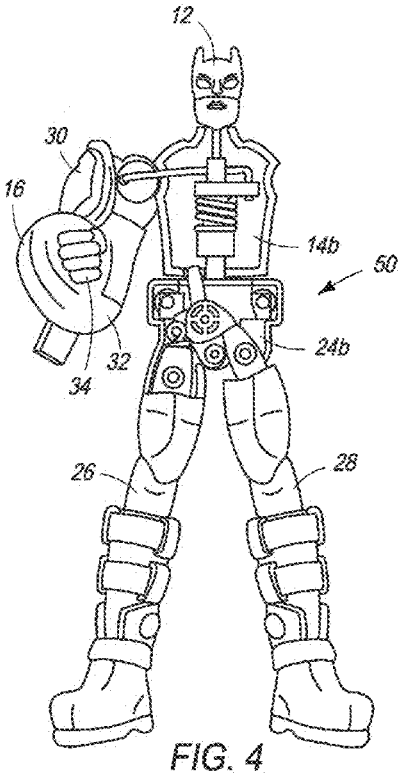
FIG. 4 shows a partial cutaway view the action figure of FIG. 1 in the first, unactivated position.
Figure 5:
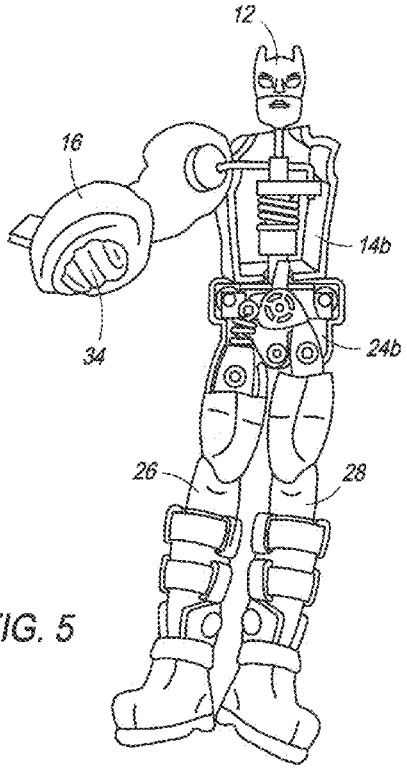
FIG. 5 shows a partial cutaway view of the action figure of FIG. 2 in the second, activated position.

The drawings illustrate embodiments and schematic concepts for animated toy figures according to the invention. The purpose of these drawing is to aid in explaining the principles of the invention. Thus, the drawings should not be considered as limiting the scope of the invention to the embodiments and schematic concepts shown therein. Other embodiments of animated toy figures may be created which follow the principles of the invention as taught herein, and these other embodiments are intended to be included within the scope of patent protection.

DETAILED DESCRIPTION OF THE DISCLOSURE

An action figure in accordance with the present disclosure, shown in FIGS. 1-24 and as described in further detail below, is a unique and realistic action figure. The action figure, also referred to as a toy figure, an animated toy figure, or a doll, may include an activation and/or rotation mechanism that, when activated, causes a first portion of the action figure, such as a torso, to rotate, while a second portion of the action figure, such as a head, remains stationary. For example, during rotation of the torso, the head may remain facing forward rather than turning with the torso. This motion may create a unique and realistic action fighting feature.

Turning first to FIGS. 1-5, an action figure, indicated generally at 10, may include an upper portion 20 and a lower portion 22. Upper portion 20 may include a head 12, a torso 14, a first arm 16, also referred to as a movable arm 16, and a second arm 18, in the form of an unanimated arm 18. One or more of torso 14 and/or first arm 16 and second arm 18 may be moveable with respect to a center axis CA, generally defined head-to-foot by the intersection of sagittal and coronal planes of action FIG. 10.

Head 12 may be a figurative or decorative element affixed to the anatomically superior end of torso 14. For example, head 12 may be molded or formed to suggest a human head with recognizable features, such as, features of a fictional character.

Lower portion 22 may include a pelvis 24, a first or fixed leg 26, and a second or movable leg 28. Pelvis 24 may be an armature-like portion of lower portion 22 that supports attachment, leverage, or rotation of fixed and movable parts of action FIG. 10. Pelvis 24 may be substantially collinear to central axis CA. Pelvis 24 may define a waist, adjacent torso 14 and opposite legs 26, 28.

Fixed leg 26 may be rigidly mounted on pelvis 24, and movable leg 28 may be rotatably mounted on pelvis 24. Squeezing together legs 26, 28 may cause leg 28 to move (with respect to center axis CA) toward leg 26, through an internal activation mechanism 50, seen best in FIGS. 3-5.

Torso 14 may be hollow form, enclosing and rotatably attached to a spine, discussed below. Torso 14 may include, for example, a molded or pressed front half 14*f* and a molded or pressed back half 14*b*, the two halves 14*f*, 14*b* configured to mate together to form an enclosure surrounding spine 25. Torso 14 may serve as a point of attachment, for example, for arms 16, 18.

Similarly, pelvis 24 may be formed from multiple pieces or elements. For example, pelvis 24 may include a molded or pressed front half 24*b* and a molded or pressed back half 24*b*, the two halves 24*a*, 24*b* being configured to mate together. Pelvis 24 may be fixed to spine 25 separate from torso 14, so that torso 14 is in between head 12 (anatomically superior to spine 25) and pelvis 24 (anatomically inferior to spine 25). For example, pelvis 24 may be fixed to spine 25 through pelvic plate 27 sandwiched between a front half of pelvis 24 and a back half of pelvis 24.

Figure 10:
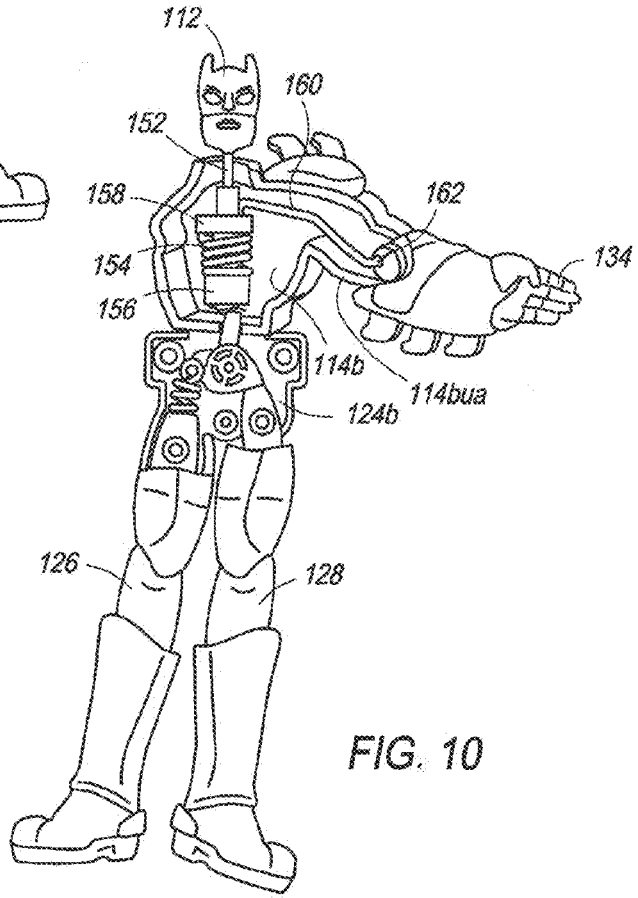
FIG. 10 shows a partial cutaway view of the action figure of FIG. 6 in the activated position.

Spine 25 may be an armature of upper portion 20, generally within torso 14, which supports attachment, leverage, or rotation of fixed or movable parts of action FIG. 10. For example, spine 25 may support torso 14 rotatably mounted on spine 25 and head 12 mounted on spine 25 separate from torso 14. Spine 25 may be substantially collinear with central axis CA. Spine 25 may include a center rod 52 and a pelvic plate 27 and may act as a point of attachment for linkage 60. Center rod 52 may be a rigid element, such as, an elongated plastic and/or metal rod. Head 12 may be attached to the superior end of center rod 52, and pelvic plate 27 may be attached to the inferior end of center rod 52. Pelvic plate 27 may in turn attach spine 25 to pelvis 24.

In an embodiment, a leg-biasing element 68 may be operatively connected between pelvis 24 and movable leg 28 to bias leg 28 to a first position, also called an unactuated or unactivated position. Leg-biasing element 68 such as a spring may in effect maintain a separation between legs 26, 28 when legs 26, 28 are not being squeezed together.

Movable arm 16 may be movably mounted on torso 14 at the proximal or shoulder end of arm 16, approximately in the manner of a human shoulder joint. Movable arm 16 may pivot or rotate on torso 14. Movable arm 16 may include a first (upper arm) portion 30 and a second (forearm) portion 32. Arm 16 may include a disk 62 to serve as a point of attachment for linkage 60 between spine 25 and movable arm 16, so that movable arm 16 moves as torso 14 rotates on spine 25.

Linkage 60 between spine 25 and movable arm 16 may operably connect spine 25 to movable arm 16, so that movable arm 16 moves as torso 14 rotates on spine 25. The proximal end of linkage 60 may attach to center rod 52 (e.g., via upper platform 58) and the distal end of linkage 60 may attach to arm 16 (e.g., via disc 62). Center rod 52 may serve as a relatively fixed point of attachment for proximal end of linkage 60, thereby aiding the transfer of a rotational motion of torso 14 to movable arm 16 via linkage 60. In an embodiment, the distal end of linkage 60 may attach to the proximal end of movable arm 16 via a disk 62 located at the proximal end of arm 16 (in effect, at or near the shoulder of arm 16). In an embodiment, the distal end of linkage 60 may attach to a disk 62 located at the distal end of arm portion 30 (in effect, at or near the elbow of arm 16).

Linkage 60 may include an arm-biasing element 54 such as a coiled spring coiled around spine 25 and attached (at one end) to spine 25 and (at the other end) to upper platform 58. Arm-biasing element 54 may maintain a relatively fixed attachment between linkage 60 and spine 25 while also providing a degree of flexibility or relief in the attachment. Arm-biasing element 54 may create, for movable arm 16, a biased freedom of motion with respect to spine 25, for example, to avoid damage to action FIG. 10 or injury to its user caused by forced motions of movable arm 16 and/or movable leg 28.

Second or unanimated arm 18 may attach to torso 14 without linkage to spine 25. The attachment between proximal end of arm 18 and torso 14 may be fixed or movable. A fixed attachment may cause arm 18 to be substantially immobile. A movable attachment may allow arm 18 to rotate, pivot, or otherwise move, e.g., to simulate some or all of the range of motion of a human shoulder joint. The motion of unanimated arm 18 may be a relatively free motion, unconstrained by a linkage to spine 25.

Action FIG. 10 may be moved between a first position (FIG. 1) (also referred to as an unactivated or unactuated position) and a second position (FIG. 2), (also referred to as an activated or actuated position). In the first position, head 12, torso 14, arms 16, 18, pelvis 24, and legs 26, 28 may face a first direction, also referred to as the forward direction. Action FIG. 10 in the first position may be configured to be in a "ready to fight" and/or "fists up" position. For example, the first and second arms 16, 18 may include a first, upper arm portion 30 disposed adjacent torso 14 and a second, forearm portion 32 at an approximate 90-degree angle with first portion 30 and/or torso 14 such that a distal end 34 or first of second portion 32 faces the first direction. The upper and lower portions 30, 32 of the first and/or second arms may be hingedly connected or may be fixed with respect to one another. First and second legs 26, 28 may be spaced from one another, e.g., as a result of the biasing force of leg-biasing element 68.

In the second position, one or more of head 12, torso 14, arms 16, 18, pelvis 24, fixed leg 26, and movable leg 28 may be rotated about the center axis CA to face a second direction, also referred to as the side direction. Action FIG. 10 in the second position may be configured to be in a "punch thrown" and/or "ka-pow" position. For example, head 12, pelvis 24, and legs 26, 28 may face the first direction. The first arm 16 may be activated such that first portion 30 is disposed at a 90-degree angle with torso 14, the upper and second portions 30, 32 are in approximately the same plane and/or distal end 34 of second portion 32 faces the first direction. Torso 14 and second arm 18 may be rotated about the center axis CA to face the second direction.

Accordingly, the action figure may be configured such that in the second position, torso 14 rotates and head 12 remains in the same position. Additionally and/or alternatively, the action figure may be configured such that in the second position torso 14 rotates, head 12 remains in the same position and first arm 16 moves to be substantially parallel with respect to the ground, such that the action figure appears to be looking in the same direction as the distal end 34 of first arm 16.

Activation of the action figure to move from the first position to the second position may include positioning and/or squeezing legs 26, 28 to be adjacent to one another, moving one or both the first and second leg 26, 28 with respect to the center axis CA, and/or moving one or both first and second legs 26, 28 to be in substantial alignment with the center axis CA. Action FIG. 10 may be biased, as discussed in further detail below, to return to the first position when the first and/or second legs are released and/or first and second legs 26, 28 return to a spaced apart position.

A lever 70 may extend from movable leg 28 into torso 14. Lever 70 may engage with torso 14 so that torso 14 rotates on spine 25 as a result of the motion of movable leg 28 This engagement may occur on either the anterior or posterior side of spine 25, for example, to cause either a clockwise or counterclockwise rotation of torso 14. In the exemplary embodiments of the figures, first or right leg 26 a fixed leg and second or left leg 28 is a movable leg. The right/left and fixed/movable relationships of legs 26, 28 may be reversed or mirrored, so that leg 26 is movable and leg 28 is fixed. Furthermore, in some embodiments, not shown, both first and second legs 26, 28 may be moveable with respect to the center axis CA, each including a corresponding lever acting on a corresponding front half or back half of the torso.

FIGS. 6-10 show an additional embodiment of an action figure, indicated generally at 110, in accordance with the present disclosure. Action FIG. 110 may include an upper portion 120 and a lower portion 122.

Upper portion 120 may include a head 112, a torso 114, a first arm 116, and a second arm 118. One or more of torso 114 and/or first and second arms 116, 118 may be moveable with respect to the center axis CA, which is defined by the intersection of the saggital and coronal planes.

Lower portion 122 may include a pelvis 124, a first leg 126, and a second leg 128. One or both of first and second legs 126, 128 may be moveable with respect to the center axis CA. action FIG. 10 may include a first position (FIG. 6) and a second position (FIG. 7), also referred to as the rotated or activated position.

In the first position, head 112, torso 114, pelvis 124 and/or first and second legs 126, 128 may face a first direction, also referred to as the forward direction. The action figure in the first position may be configured to be in a "ready to fight" and/or "weapons up" position. For example, the first arm 116 may include a first portion 130 at an angle with respect to torso 114 and/or a second portion 132 at an approximate 90-degree angle with respect to first portion 130, such that a distal end or first of second portion 132 faces up or away from first and second legs 126, 128. The second arm may include a first portion 130 disposed adjacent torso 114 and a second portion 132 disposed at a 90-degree angle with first portion 130. Distal end 134 of second portion 132 of the second arm may face a second direction, also referred to as the side direction. The first and second portions of the first and/or second arms may be hingedly connected or may be fixed with respect to one another. First and second legs 126, 128 may be spaced from one another.

In the second position, one or more of head 112, torso 114, the first and second arms 116, 118, waist 124 and first and second legs 126, 128 may be rotated about the center axis CA to face the second direction. The action figure in the second position may be configured to be in a "weapons drawn" and/or "ka-pow" position. For example, head 112, waist 124 and first and second legs 126, 128 may remain facing the first direction. Torso 114 and second arm 118 may be rotated about the center axis CA such that torso 114 faces the second direction and distal end 134 of the second arm 118 faces the first direction. The first arm 116 may be activated such that first portion 120 is disposed at a 90-degree angle with torso 114 or center axis CA, the first and second portions are in approximately the same plane and/or distal end 134 of second portion 122 faces the first direction.

Activation of the action FIG. 110 to move from the first position to the second position may include positioning and/or squeezing first and second legs 126, 128 to be adjacent one another, moving one or both the first and second leg with respect to the center axis CA, and/or moving one or both first and second legs 126, 128 to be in substantial alignment with the center axis CA. Action FIG. 110 may be biased, as discussed in further detail below, to return to the first position when the first and/or second legs are released and/or first and second legs 126, 128 return to a spaced apart position.

Figure 8:
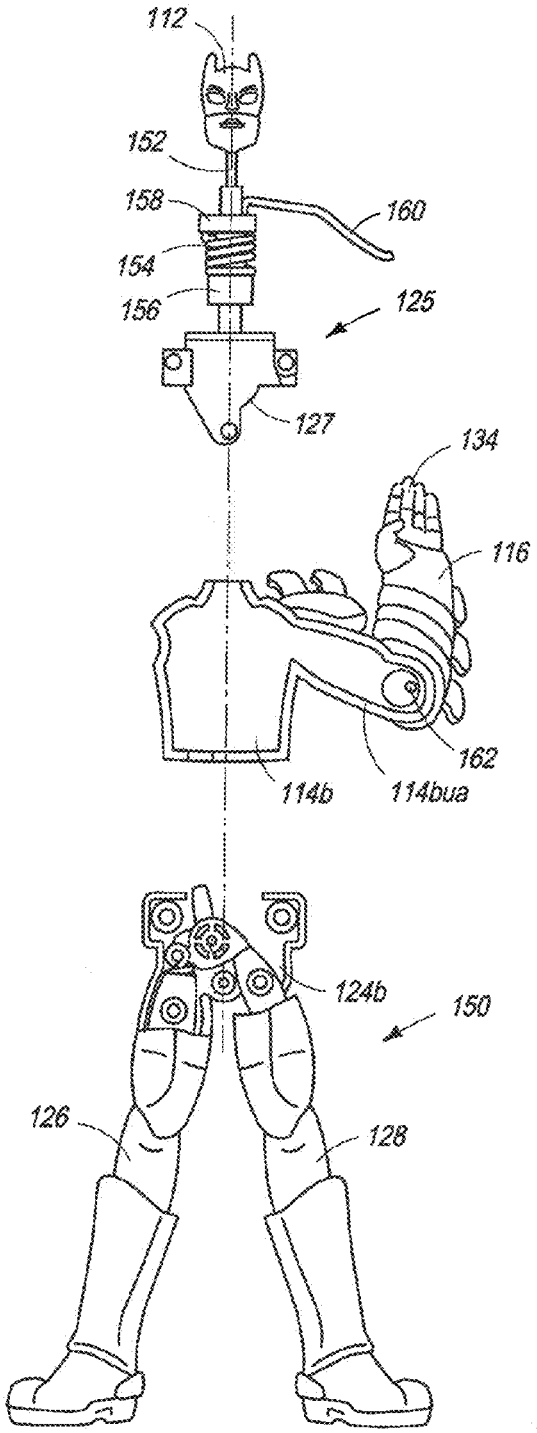
FIG. 8 shows an exploded view of portions of the action figure of FIG. 6, including a torso, a spine with a pelvic plate, a pelvis, a linkage, and a movable arm, in accordance with the present disclosure.
Figure 9:
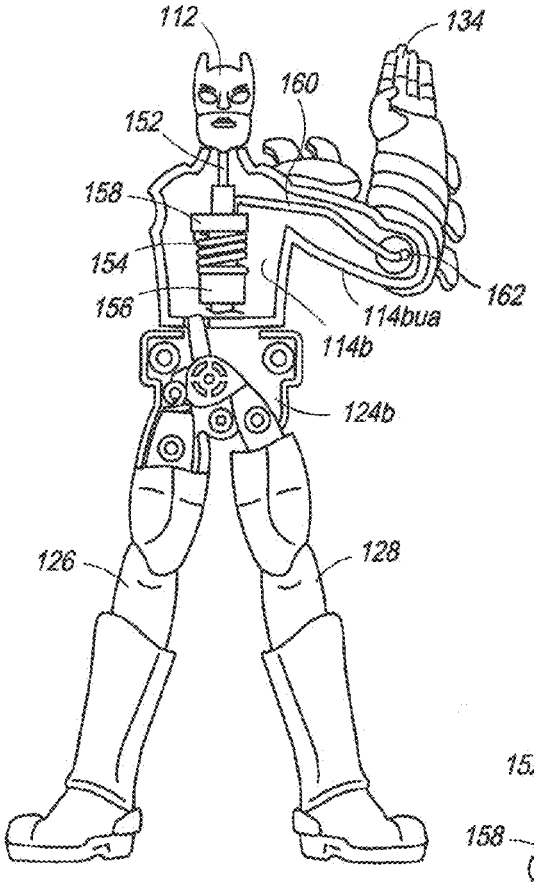
FIG. 9 shows a partial cutaway view of the action figure of FIG. 7 in the first or unactivated position.

In the embodiment of FIGS. 6-10, torso 114 may include may include a hollow, rigid upper arm portion 114*ua*. Upper arm portion 114*ua* may be formed as a rigid extension 114*fua* of torso front half 114*f* and a corresponding rigid extension 114*fbua* of torso back half 114*f* (FIG. 8). Alternatively, a hollow upper arm portion 130 may be rigidly attached to torso 114. A movable arm or forearm 116 may be movably attached to the distal end of upper arm portion 114*ua* (or to rigidly attached hollow upper arm 130). Disk 162 may be located at the distal (elbow) end of upper arm portion 114*ua* or 130, and linkage 160 may extend through the torso 114 including hollow upper arm portion 114*ua* or 130. Distal end of linkage 160 may attach to disk 162, in order to communicate the motion of the rotating torso 114 to movable arm or forearm 116. Movable arm or forearm 116 accordingly moves in response to the rotation of torso 114, and ultimately in response to the motion of movable leg 128.

Figure 11:
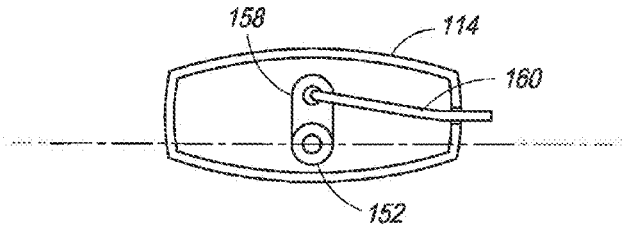
FIG. 11 shows an approximate cross-section of the action figure of FIG. 6 showing a position of the linkage relative to the torso in the first, unactivated position.
Figure 12:
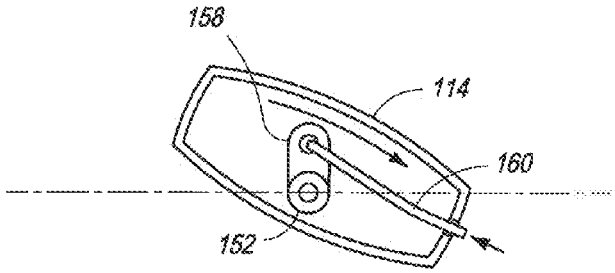
FIG. 12 shows a cross-section of the action figure of FIG. 11 showing a position of the linkage relative to the torso in the second, activated position.

As shown in FIGS. 11 and 12, upper platform 158 may be substantially rigidly attached to center rod 152. With torso 114 in the first or unactivated position (FIG. 11), linkage 160 may protrude outside torso 114 by a certain amount. As torso 114 rotates to the second or activated position (FIG. 12), linkage 160 may protrude outside torso 114 by a lesser amount. The rotation from first to second positions in effect causes a portion of linkage 160 to withdraw inside torso 114. This reduction of length in the protruding portion of linkage 160, transferred to the movable arm attached to linkage 160, may cause the movable arm to move from its unactivated position to its activated position.

The embodiment of FIGS. 1-5 may exhibit the same or similar relationships, so that the rotation of torso 14 from its unactivated position to its activated position causes linkage 14 to partially retract within torso 14. This retraction, transferred by linkage 60 to movable arm 16, causes arm 16 to move from its unactivated position to its activated position.

Figure 13:
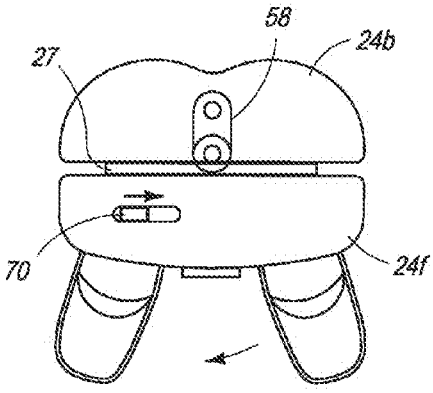
FIG. 13 shows an approximate cross-section of the action figure of FIG. 1 showing a partially exploded pelvis including a front pelvic half and a back pelvic half, with the pelvic plate sandwiched between a front pelvic half and a back pelvic half and showing a position of the lever dorsal to the spine.
Figure 14:
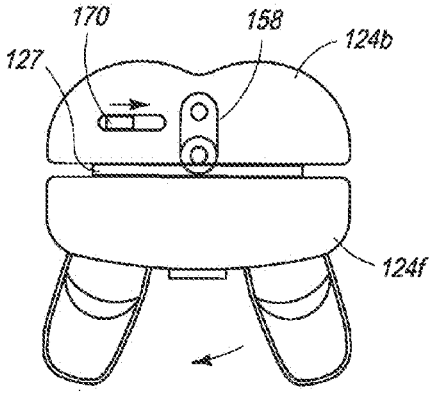
FIG. 14 shows an approximate cross-section of the action figure of FIG. 6 showing a partially exploded pelvis including a front pelvic half and a back pelvic half, with the pelvic plate sandwiched between a front pelvic half and a back pelvic half and showing a position of the lever ventral to the spine.

With reference now to FIGS. 13 and 14, lever 70 or 170 may be anterior or posterior to central rod 60 or 160 of spine 25 or 125, and the relative position of the lever and rod may control the direction of the rotation ultimately transferred to torso 14 or 114. Referring first to FIG. 13, which corresponds to the embodiment of FIGS. 1-5, lever 70 may be positioned anterior to (that is, on the front side of) central rod 58, placing lever 70 within front half 24*f* of pelvis 24. Lever 70 accordingly protrudes into front half 14*f* of torso 14. Squeezing legs 26, 28 together accordingly causes lever 70 to slide toward center rod 58 as shown by the associated arrow in FIG. 13. This motion, transferred to torso 14 by lever 70, causes torso 14 to rotate counterclockwise (as viewed head to foot) around rod 58. This rotation, transferred by torso 14 to arm 16, may in turn cause a retraction of linkage 60 as shown in FIGS. 11 and 12.

Referring now to FIG. 14, which corresponds to the embodiment of FIGS. 6-10, placing lever 170 posterior to (that is, on the back side of) center rod 158, within back half 124*b* of pelvis 124, may instead cause a clockwise rotation of torso 114. Squeezing legs 126, 128 together moves lever 170 toward center rod 158, as indicated by the associated arrow in FIG. 14. This motion, transferred to torso 114 by lever 170, causes torso 114 to rotate clockwise around rod 158. This rotation of torso 114, transferred to the movable arm, may then cause the retraction of linkage 160 as shown in FIGS. 11 and 12.

Figure 15:
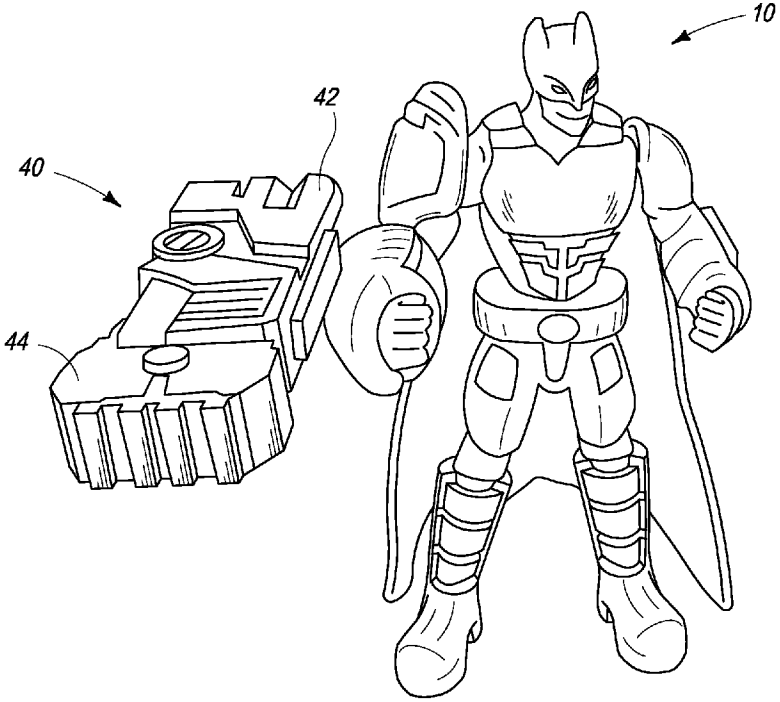
FIG. 15 is a photograph of an upper front perspective view of the action figure of FIG. 1 further showing an accessory with a movable element in a retracted position in accordance with the present disclosure.
Figure 16:
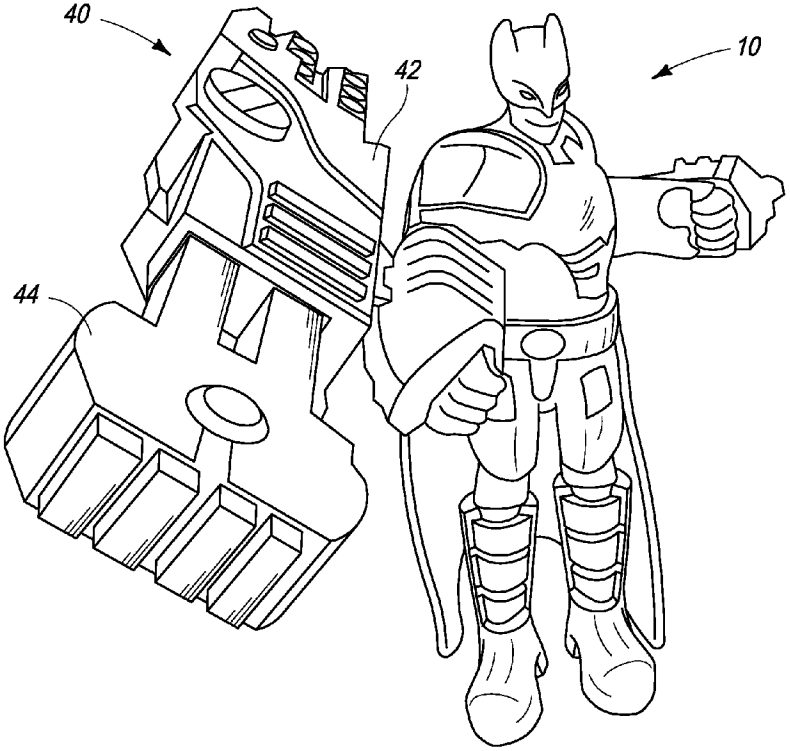
FIG. 16 is a photograph of an upper front perspective view of the action figure of FIG. 2 further showing the accessory with a movable element in an extended position in accordance with the present disclosure.
Figure 17:
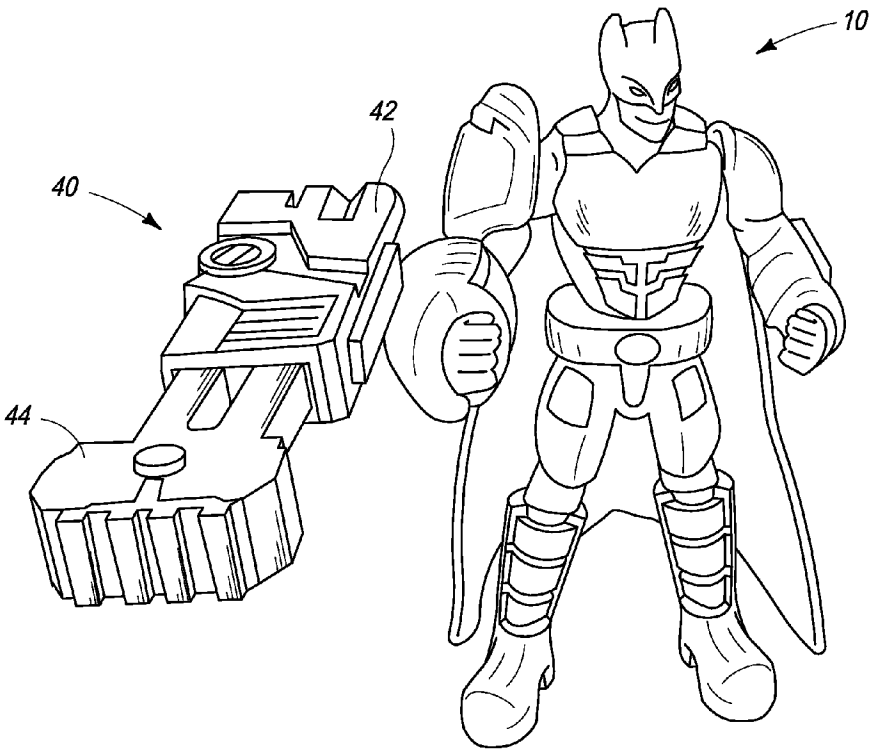
FIG. 17 is a photograph of an upper front perspective view of the action figure of FIG. 1 further showing the accessory in the with a movable element in an extended position in accordance with the present disclosure.

Some embodiments of the action figure may include one or more accessories that may be removably mounted to a portion of the action figure, for example, to second portion 32 of the first arm 16. Turning first to FIGS. 15-17, an accessory 40 may include a housing 42 and a distal portion 44 or movable element 44 that may be slidingly engaged with the housing 42 such that distal portion 44, also referred to as movable element 44, includes a retracted position (FIG. 15) and an extended position (FIGS. 16 and 17). Accessory 40 may be removably disposed on the upper limb, e.g., arm 16 and/or arm 18.

In the first position (FIG. 15), accessory 40 may be in the retracted position. In the second position (FIGS. 16 and 17), accessory 40 may be in the extended position. In some embodiments, a force of activating the animated toy figure may cause movable element 44 to move. For example, the momentum of the transition from the first position to the second position may cause accessory 40 to move from the retracted position to the extended position. Momentum of the transition from the second position to the first position may cause accessory 40 to move from the extended position to the retracted position. Additionally and/or alternatively, distal end 44 may have to be pushed back into the housing 42 to return to the retracted position (FIG. 15) and/or distal end 44 may be biased to return to the retracted position.

Figure 18:
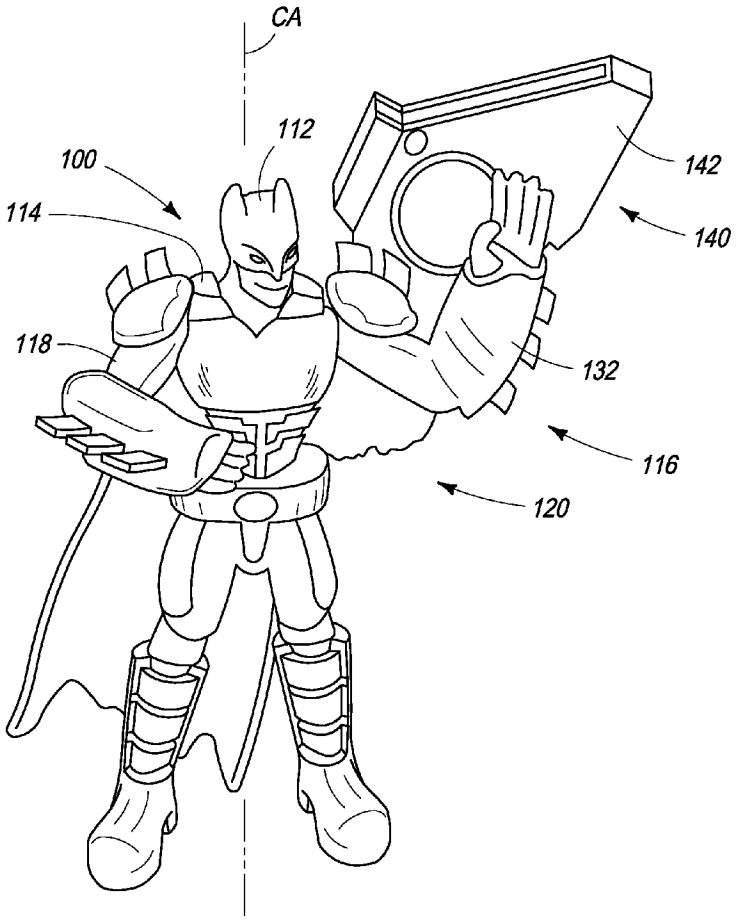
FIG. 18 is a photograph of an upper front perspective view of an action figure of FIG. 17 in a first position having a head, a torso, and legs facing forward and an accessory in a retracted position in accordance with the present disclosure.
Figure 19:
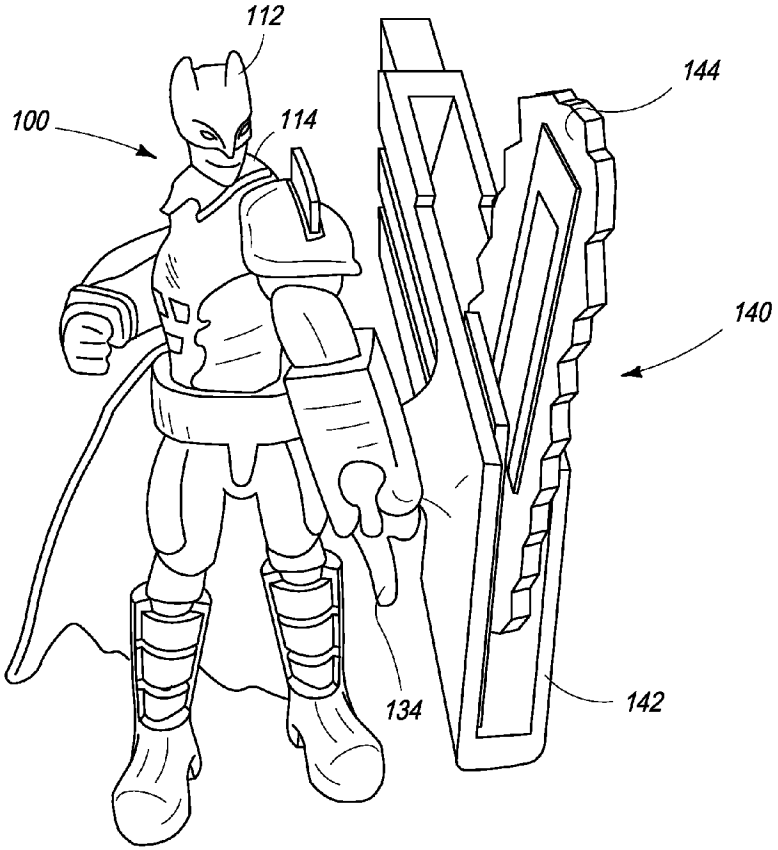
FIG. 19 is a photograph of an upper front perspective view of the action figure of FIG. 18 in a second position having a head and legs facing forward and torso rotated and the accessory in an intermediate position in accordance with the present disclosure.
Figure 20:
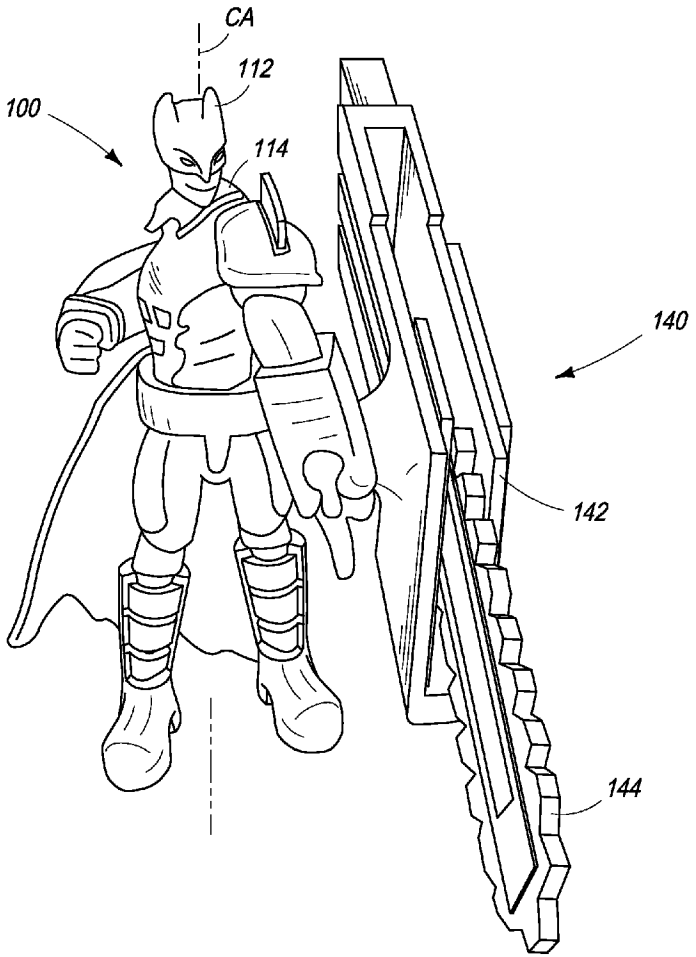
FIG. 20 is a photograph of an upper front perspective view of the action figure of FIG. 19 having the accessory in an extended position in accordance with the present disclosure.
Figure 21:
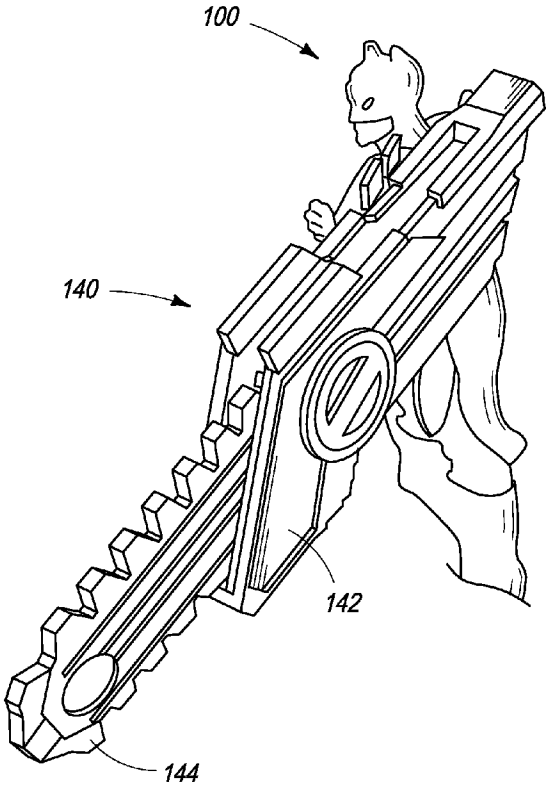
FIG. 21 is a photograph of an upper side perspective view of the action figure of FIG. 20.
Figure 22:
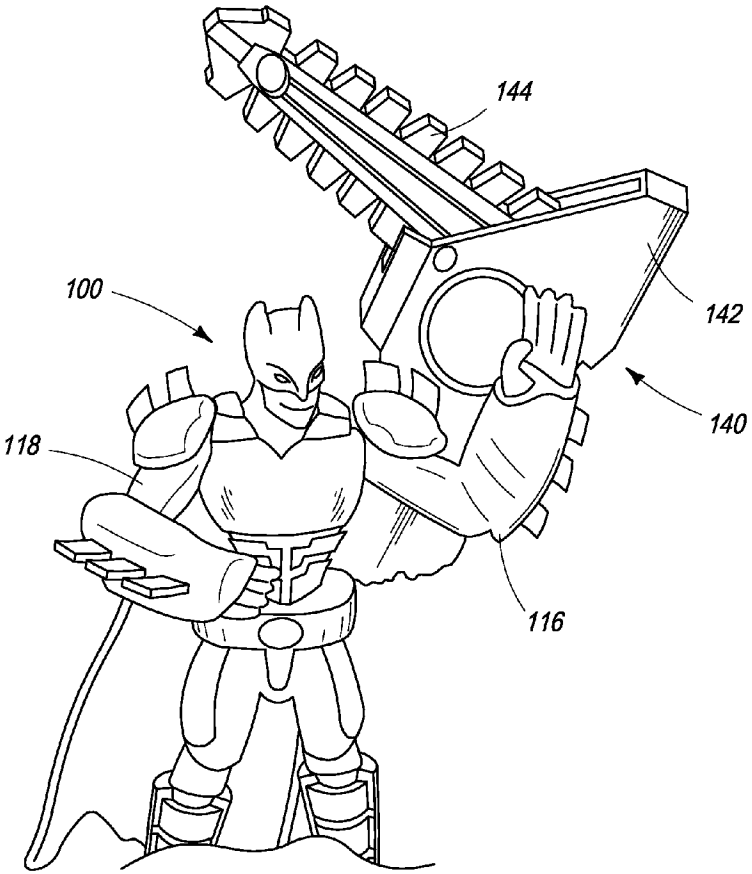
FIG. 22 is a photograph of an upper front perspective view of the action figure of FIG. 1 in the first position and the accessory in the intermediate position in accordance with the present disclosure.

Turning now to FIGS. 18-22, some embodiments of the action figure may include one or more accessories, such as accessory 140, that may be mounted to a portion of the action figure, for example, to lower portion 122 of the first arm. Accessory 140 may include a housing 142 and a blade portion 144, also referred to as a movable element 144, that may be pivotally engaged with the housing 142 such that the blade portion 144 includes a retracted position (FIG. 18) and an extended position (FIGS. 10-22). The sequence of FIGS. 18 to 19 to 20 show exemplary transition from retracted to extended positions. Accessory 140 may be removably disposed on an upper limb, e.g., arm 16 and/or arm 18.

In the first position (FIG. 18), accessory 140 may be in the retracted position. In the second position (FIGS. 20 and 21), accessory 140 may be in the extended position. In some embodiments, a force of activating the animated toy figure may cause movable element 144 to move. For example, momentum of the transition from the first position to the second position may cause accessory 140 to move from the retracted position to the extended position. Momentum of the transition from the second position to the first position may cause accessory 140 to move from the extended position to the retracted position. Additionally and/or alternatively, the movable element 144 may have to be pushed back into the housing 142 to return to the retracted position and/or element 144 may be biased to return to the retracted position.

Figure 23:
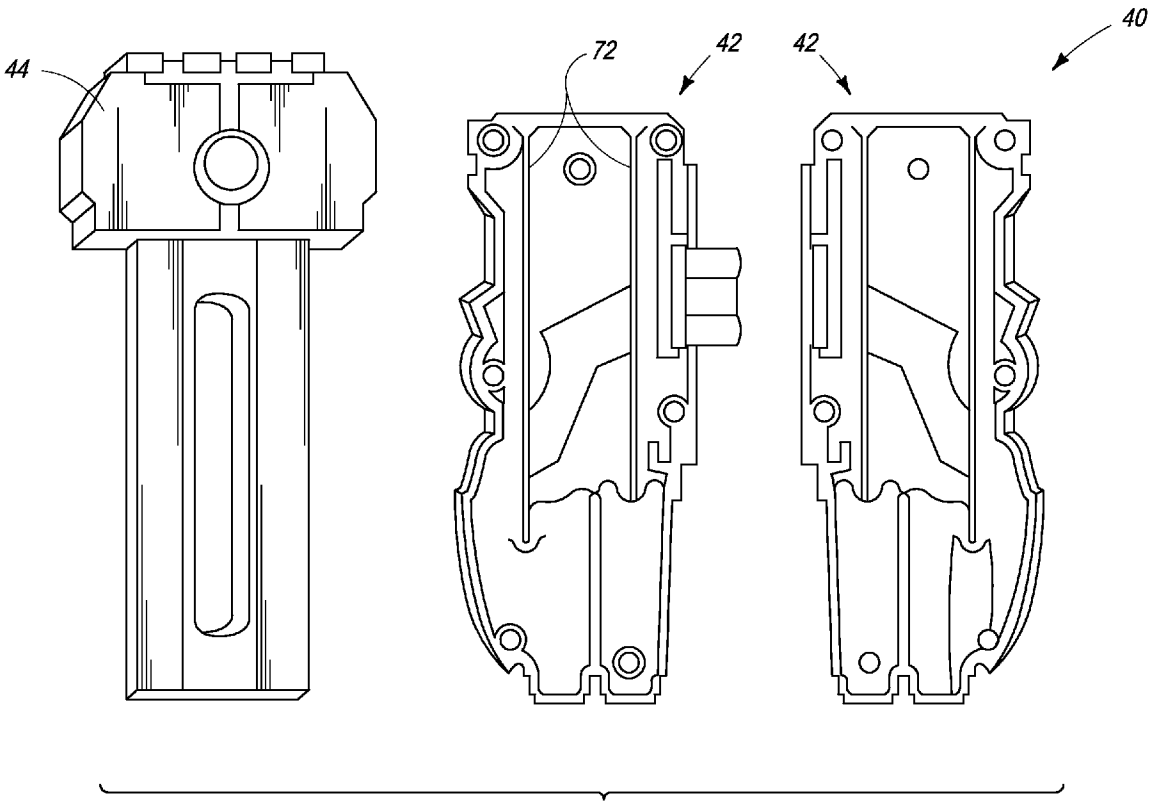
FIG. 23 is a photograph of an accessory, shown split in half, for an action figure in accordance with the present disclosure.

FIG. 23 shows accessory 40, including distal end 44 having an elongate member and a housing 42, shown split in half. The housing 42 may include rails 72 such that the elongate member 44 may be slideable in and out of the housing 42.

Figure 24:
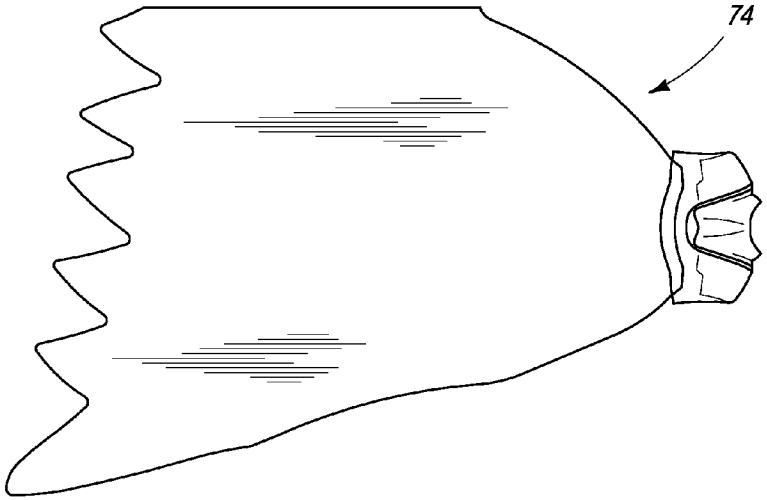
FIG. 24 is a photograph of a back piece with a cape and an arm that may be movably connected to the torso of an action figure in accordance with the present disclosure.

FIG. 24 shows a back piece 74 including a cape.

The action figure in accordance with the present disclosure may include an internal activation mechanism 50, also referred to as an actuating mechanism, which may be configured to cause transition between the first position and the second position. Activation mechanism 50 may be disposed within one or both of upper portion 20 and lower portion 22. Movement of one or both of first and second legs 26, 28 may trigger activation of activation mechanism 50 to cause torso 14 to rotate about the center axis CA, while the head 12 may remain stationary during rotation of torso 14.

Activation mechanism 50 may be operably connected to one or more of first and second legs 26, 28, the first and second arms 16, 18, head 12 and/or torso 14. Activation mechanism 50 may not be operably connected to other parts, such as one or more of first and second legs 26, 28, the first and second arms 16, 18, head 12 and/or torso 14. For example, activation mechanism 50 may be operably connected to the first leg, torso 14 and the first arm. Additionally and/or alternatively, activation mechanism 50 may not be operably connected to the second leg, head 12 and the second arm.

The upper portion may include a center rod 52 in substantial alignment with the center axis CA and on which head 12 may be mounted. A biasing element 54 may wrap around the rod 52. The lower end of the center rod 52 and/or biasing element 54 may be connected to a lower platform 56 and the upper end of the center rod 52 and/or biasing element 54 may be connected to an upper platform 58.

The upper platform 58 may be further connected via a linkage 60 to a disk 62 adjacent to the first arm 16. The disk 62 may be rotatable and may be operably connected to cause movement of the first arm 16. The first arm 16 may be rotatably and/or otherwise moveably attached to torso 14. The second arm 18 may also be rotatably and/or otherwise moveably attached to torso 14.

The center rod 52 may extend into lower portion 22 and/or may be operably connected to activation mechanism 50 disposed in lower portion 22. The center rod 52 may include a tubular portion 64 surrounding a screw 66. Lower portion 22 may include a biasing element 68 that may extend into the second leg. An elongate member 70 may extend into the first leg. A portion of the elongate member 70 may partially wrap around the tubular portion 64 of the rod 52. One or both of first and second legs 26, 28 may be moveable with respect to the rod 52 and/or the center axis CA.

A further example of an action FIG. 110 in accordance with the present disclosure may include an internal activation mechanism 150, also referred to as an actuating mechanism, which may be configured to cause transition between the first position and the second position. Activation mechanism 150 may be disposed within one or both of upper portion 120 and lower portion 122. Movement of one or both of first and second legs 126, 128 may trigger activation of activation mechanism 150 to cause torso 114 to rotate about the center axis CA. Head 112 may remain stationary during rotation of torso 114.

Activation mechanism 150 may be operably connected to one or more of first and second legs 126, 128, the first and second arms 116, 118, head 112 and/or torso 114. Activation mechanism 150 may not be operably connected to other parts, such as one or more of first and second legs 126, 128, the first and second arms 116, 118, head 112 and/or torso 114. For example, activation mechanism 150 may be operably connected to the first leg 126, torso 14 and the first arm 116. Additionally and/or alternatively, activation mechanism 150 may not be operably connected to the second leg 128, head 112 and the second arm 118.

The upper portion 120 may include a center rod 152 in substantial alignment with the center axis CA and on which head 112 may be mounted. A biasing element 154 may wrap around the rod 152. The lower end of the rod 152 and/or biasing element 154 may be connected to a lower platform 156 and the upper end of the rod 152 and/or biasing element 154 may be connected to an upper platform 158.

The upper platform 158 may be further connected via a rod 160 to a disk 162 disposed between the first and second portions 130, 132 of the first arm 116. The disk 162 may be rotatable and may be operably connected to cause movement of the first arm 116, for example movement of second portion 132 from a 90-degree angle with respect to first portion 130, to a substantially same plane as first portion 130. The second arm 118 may be rotatably and/or otherwise moveably attached to torso 114 for example via a ball and socket joint.

A lever 170 may extend from the lower portion 122 into upper portion 120 and/or may be operably connected to activation mechanism 150 disposed in lower portion 122. Lower portion 122 may include a spring 164 that may extend into the first leg 128. An elongate member 166 may extend into the second leg 126. One or both of first and second legs 126, 128 may be moveable with respect to the rod 152 and/or the center axis CA.

An action figure in accordance with the present disclosure may also be described as follows: an action figure may include a feature in that when the figure's legs are squeezed to activate the internal mechanism action feature (punching/karate chopping/etc), the figure's head remains facing FORWARD rather than turning with torso as on other feature figures. This creates a unique and realistic action fighting feature. These figures may also include snap-on attachable/detachable accessories w/simple mechanisms (gravity slides/hinges/etc) that "amplify" the figure's play feature.

An action figure in accordance with the present disclosure may also be described as follows: The action figures feature a head, upper torso, and lower torso having two legs. The lower torso and head are coupled to one another by a vertical post, and the legs are squeezed together to actuate rotation of the upper torso, while the head remains fixed. Additional features include a slide element removably fixed to the hands of the figure, allowing the slide to extend and contract (due to centrifugal force) when the upper torso rotates.

In one example, a toy figure (also called an action figure) incorporates a spine; a torso rotatably mounted on the spine; a head mounted on the spine separate from the torso; a pelvis fixed to the spine separate from the torso, so that the torso is between the head and pelvis; a movable leg mounted on the pelvis, with a lever extending from the movable leg into the torso so that the torso rotates on the spine as the movable leg moves on the pelvis; a movable arm movably mounted on the torso; and a linkage between the spine and the movable arm, so that the movable arm moves as the torso rotates on the spine.

The toy figure may further include a leg-biasing element operatively connected between the pelvis and the movable leg to bias the leg to an unactuated position. The toy figure may further include an arm-biasing element that allows forced movement of the arm relative to the torso, spine, and pelvis. The arm-biasing element may be a coil spring coiled around the spine. The toy figure may affix the pelvis to the spine through a pelvic plate sandwiched between two pelvic halves.

Some embodiments may further include a packaged toy, which may include a package with an elevated support and a toy figure, wherein the pelvis of the toy figure is releasably attached to the support; the movable leg is exposed for movement relative to the package; the torso is allowed to rotate relative to the package; and the movable arm is allowed to move relative to the package. The packaged toy may further include an accessory that removably attaches to the movable arm. The accessory may include a movable element that moves as the movable arm moves, when the accessory is attached to the movable arm.

In another example, an animated toy figure includes an upper portion including a head and a torso; a lower portion moveably secured to the upper portion, the lower portion including a moveable lower limb; and an actuating mechanism disposed within the upper and lower portions, the actuating mechanism operably connected to the lower limb and the torso, wherein movement of the lower limb triggers activation of the actuating mechanism to cause the torso to rotate about a center axis and wherein the head remains stationary during rotation of the torso. The upper portion may further include at least one upper limb operably connected to the actuating mechanism, wherein activation of the actuating mechanism causes the upper limb to move relative to the torso. The linkage may further include an arm-biasing element that allows forced movement of the arm relative to the torso, spine, and pelvis. The toy figure may further include a spine extending through the torso and connecting the head to the lower portion. The toy figure may further include a pelvis fixed to the spine through a pelvic plate sandwiched between two pelvic halves. The toy figure may further include a lower limb that includes a biasing element secured to the lower portion, where the biasing element biases the lower limb to an unactuated position. The toy figure may further comprise an accessory removably disposed on the upper limb. The accessory may further include a movable element, wherein a force of activating the toy figure causes the movable element to move.

In another example, the invention may include a toy figure including a first leg and a second leg; an actuating mechanism driven by squeezing the first leg toward the second leg; a rotatable torso operatively connected to the actuating mechanism; a movable arm operatively connected to the actuating mechanism; and a head frictionally fixed by a spine to the first leg so that the head remains fixed while the torso rotates and the arm moves.

In yet another example, the invention may include a toy figure including a head, an upper torso, and a lower torso having two legs; wherein: the lower torso and the head are coupled to one another by a vertical post and the two legs may be squeezed together to actuate rotation of the upper torso, while the head remains fixed. The upper torso that further includes a movable upper limb supported by the upper torso and operably connected to one of the two legs, wherein rotation of the upper torso relative to the two legs causes the movable upper limb to move relative to the upper torso. The toy figure may further include a movable upper limb that is a forearm, an upper torso that includes a hollow upper arm formed as a rigid portion of the upper torso, where the forearm moves relative to the hollow upper arm; a linkage extends through the upper torso and through the hollow upper arm to connect to the forearm.

While embodiments of various animated toy figures have been particularly shown and described, many variations may be made therein. This disclosure may include one or more independent or interdependent embodiments directed to various combinations of features, functions, elements and/or properties. Other combinations and sub-combinations of features, functions, elements and/or properties may be claimed later in a related application. Such variations, whether they are directed to different combinations or directed to the same combinations, whether different, broader, narrower or equal in scope, are also regarded as included within the subject matter of the present disclosure. Accordingly, the foregoing embodiments are illustrative, and no single feature or element, or combination thereof, is essential to all possible combinations that may be claimed in this or a later application.

It is believed that the disclosure set forth herein encompasses multiple distinct inventions with independent utility. While each of these inventions has been disclosed in its preferred form, the specific embodiments thereof as disclosed and illustrated herein are not to be considered in a limiting sense as numerous variations are possible. Each example defines an embodiment disclosed in the foregoing disclosure, but any one example does not necessarily encompass all features or combinations that may be eventually claimed. Where the description recites "a" or "a first" element or the equivalent thereof, such description includes one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated.

What is claimed is:

1. A toy figure, comprising a spine;

a torso rotatably mounted on the spine;

a head mounted on the spine separate from the torso;

a pelvis fixed to the spine separate from the torso so that the torso is between the head and the pelvis;

a movable leg mounted on the pelvis, with a lever extending from the movable leg into the torso so that the torso rotates on the spine as the movable leg moves on the pelvis;

a movable arm movably mounted on the torso; and a linkage between the spine and the movable arm so that the movable arm moves as the torso rotates on the spine;

wherein the linkage is connected to the spine and operatively connected to the arm, and rotation of the torso is configured to cause movement of the arm relative to the torso via at least partial retraction of a portion of the linkage into the torso.

2. A toy figure according to claim 1, further comprising a leg-biasing element operatively connected between the pelvis and the movable leg to bias the movable leg to an unactuated position.

3. A toy figure according to claim 1, wherein the linkage further comprises an arm-biasing element that allows forced movement of the arm relative to the torso, the spine, and the pelvis.

4. A toy figure according to claim 3, wherein the arm-biasing element is a coil spring coiled around the spine.

5. A toy figure according to claim 1, wherein the pelvis is fixed to the spine through a pelvic plate sandwiched between two pelvic halves.

6. A toy figure according to claim 1, wherein:

the movable arm is a forearm, the torso includes a hollow upper arm formed as a rigid portion of the torso, and the forearm moves relative to the hollow upper arm; and the linkage extends through the torso and through the hollow upper arm to connect to the forearm.

7. A toy figure according to claim 1 further comprising an accessory removably disposed on the movable arm.

8. A toy figure according to claim 7, wherein the accessory further includes a movable element wherein a force generated as the movable arm moves causes the movable element to move.

9. An animated toy figure comprising:

an upper portion including a head and a torso;

a lower portion moveably secured to the upper portion, the lower portion including a moveable lower limb;

an actuating mechanism extending from the lower limb into the torso, and configured such that movement of the lower limb triggers activation of the actuating mechanism to cause the torso to rotate about a center axis while the head remains stationary during rotation of the torso about the center axis;

a movable arm operatively connected to the actuating mechanism by a linkage; and a spine extending from the lower portion with the head fixed to the spine so that the head remains fixed while the torso rotates;

wherein the linkage is connected to the spine and operatively connected to the arm, and rotation of the torso is configured to cause movement of the arm relative to the torso via at least partial retraction of a portion of the linkage into the torso.

10. The animated toy figure of claim 9 wherein the movable arm is movably attached to the upper portion and operably connected to the actuating mechanism, wherein activation of the actuating mechanism causes the movable arm to move relative to the torso.

11. A toy figure according to claim 10, wherein the actuating mechanism further comprises an arm-biasing element that allows forced movement of the movable arm relative to the torso.

12. A toy figure according to claim 11, wherein the arm-biasing element is a coil spring coiled around the spine.

13. A toy figure according to claim 12, wherein the lower portion includes a pelvis, and the pelvis is fixed to the spine through a pelvic plate sandwiched between two pelvic halves.

14. The animated toy figure of claim 9 wherein the lower limb further includes a biasing element secured to the lower portion, wherein the biasing element biases the lower limb to an unactuated position.

15. The animated toy figure of claim 10, further comprising an accessory removably disposed on the movable arm.

16. The animated toy figure of claim 15, wherein the accessory further includes a movable element wherein a force of activating the animated toy figure causes the movable element to move.

17. An action figure, comprising:

a first leg and a second leg;

an actuating mechanism driven by squeezing the first leg toward the second leg;

a rotatable torso operatively connected to the actuating mechanism;

a movable arm operatively connected to the actuating mechanism by a linkage having first and second end portions; and a head frictionally fixed by a spine to the first leg so that the head remains fixed while the torso rotates about a center axis associated with the spine;

wherein the first end portion of the linkage is connected to the spine at a position offset from the center axis, the second end portion of the linkage being operatively connected to the arm, and rotation of the torso about the center axis being configured to cause movement of the arm relative to the torso via at least partial retraction of the second end portion of the linkage into the torso.

18. A toy figure according to claim 17, wherein the actuating mechanism further comprises an arm-biasing element that allows forced movement of the movable arm relative to the torso.

19. A toy figure according to claim 18, wherein the arm-biasing element is a coil spring coiled around the spine.

20. A toy figure of claim 17, wherein:

the movable arm includes a forearm;

the rotatable torso includes a hollow upper arm formed as a rigid portion of the rotatable torso, and the forearm moves relative to the hollow upper arm; and the linkage extends through the rotatable torso and through the hollow upper arm to connect to the forearm.

21. A toy figure, comprising:

a head;

an upper torso;

a lower torso having two legs;

an actuating mechanism extending from at least one of the two legs into the upper torso; and a movable arm operatively connected to the actuating mechanism by a linkage;

wherein:

the lower torso and the head are coupled to one another by a vertical post;

the linkage is connected to the vertical post and operatively connected to the arm;

the two legs are configured to be squeezed together to actuate rotation of the upper torso via the actuating mechanism, while the head remains fixed; and rotation of the upper torso is configured to cause movement of the arm relative to the upper torso via at least partial retraction of a portion of the linkage into the upper torso.

22. A toy figure of claim 21 wherein the movable arm is movably attached to the upper torso and operably connected to one of the two legs, wherein rotation of the upper torso relative to the two legs causes the movable arm to move relative to the upper torso.

23. A toy figure of claim 22, wherein:

the movable arm is a forearm, the upper torso includes a hollow upper arm formed as a rigid portion of the upper torso, and the forearm moves relative to the hollow upper arm; and the linkage extends through the upper torso and through the hollow upper arm to connect to the forearm.

* * * * *